US007992583B2

(12) United States Patent
Lisenby

(10) Patent No.: US 7,992,583 B2
(45) Date of Patent: Aug. 9, 2011

(54) RECONFIGURABLE, MODULAR, TWO-IN-ONE WALKING SUPPORT SYSTEM

(75) Inventor: Marion Lisenby, Virginia Beach, VA (US)

(73) Assignee: Inventive Solutions LLC, Virginia Beach, VA (US)

( * ) Notice: Subject to any disclaimer, the term of this patent is extended or adjusted under 35 U.S.C. 154(b) by 0 days.

(21) Appl. No.: 12/618,313

(22) Filed: Nov. 13, 2009

(65) Prior Publication Data

US 2010/0101615 A1 Apr. 29, 2010

Related U.S. Application Data

(62) Division of application No. 10/947,767, filed on Sep. 22, 2004, now Pat. No. 7,637,273.

(51) Int. Cl.
*A45B 9/00* (2006.01)

(52) U.S. Cl. ..... 135/66

(58) Field of Classification Search ..... 135/65, 135/66, 68, 74, 76
See application file for complete search history.

(56) References Cited

U.S. PATENT DOCUMENTS

| | | | | | |
|---|---|---|---|---|---|
| D33,206 | S | * | 9/1900 | Stocker | D3/5 |
| 1,375,912 | A | | 4/1921 | Huddle | |
| 2,210,493 | A | * | 8/1940 | Lisi | 135/66 |
| 3,032,048 | A | | 5/1962 | Hoffmann | |
| 3,465,993 | A | * | 9/1969 | Muehlhausen | 248/96 |
| 4,278,274 | A | * | 7/1981 | Ray | 280/821 |
| 4,556,075 | A | | 12/1985 | Hoffman | |
| D307,665 | S | * | 5/1990 | Pressley | D3/6 |
| 4,995,412 | A | * | 2/1991 | Hirn et al. | 135/67 |
| 5,056,545 | A | * | 10/1991 | Spaeth | 135/66 |
| 5,197,501 | A | * | 3/1993 | Ragatz | 135/66 |
| 5,303,954 | A | * | 4/1994 | Suda | 280/819 |
| 5,331,988 | A | * | 7/1994 | Harmon | 135/65 |
| 5,339,849 | A | | 8/1994 | Stutz | |
| 5,577,827 | A | * | 11/1996 | Leffingwell et al. | 362/109 |
| 5,934,300 | A | * | 8/1999 | Breton | 135/65 |
| 6,011,481 | A | * | 1/2000 | Luther et al. | 340/686.1 |
| 6,206,019 | B1 | | 3/2001 | Horvitz | |
| 6,561,206 | B1 | | 5/2003 | Wilkinson | |
| 2003/0205266 | A1 | | 11/2003 | Luckstead | |
| 2005/0274404 | A1 | | 12/2005 | Bergman | |
| 2006/0090782 | A1 | | 5/2006 | Bergman | |

* cited by examiner

*Primary Examiner* — Noah Chandler Hawk
(74) *Attorney, Agent, or Firm* — Blank Rome LLP

(57) ABSTRACT

There is provided a modular walking support system separable into two independently functioning walking supports, typically cane-like structures. Fastening elements hold the two walking supports together in a unitary walking support until two independent supports may be required by a user. The two sections may be manually separated or, optionally, a force augmenting mechanism may also be provided to facilitate separation by users having very little hand strength. The tip of the walking support remains in firm contact with the ground during both separation and reunification operation thereby providing continuous support to a user of the device. A variety of interchangeable handles, shaft portions, and tips are provided. In addition, many accessories may be provided, either within the structure or as add-on devices. The modular walking support is provided in colors, with decorations, etc. to help overcome the stigma perceived by some users arising from usage of such a device.

20 Claims, 12 Drawing Sheets

RECONFIGURABLE, MODULAR, TWO-IN-ONE WALKING SUPPORT SYSTEM

RELATED APPLICATIONS

This application is a divisional of U.S. patent application Ser. No. 10/947,767, filed Sep. 22, 2004, the disclosure of which is incorporated herein by reference.

FIELD OF THE INVENTION

The present invention relates to walking support systems, specifically to the familiar cane. More particularly, the present invention provides a modular, reconfigurable walking support system forming a two-in-one cane-like structure which separates into two components, each independently usable as a walking support (i.e., cane) and which components attach to one another to form a singular walking support.

BACKGROUND OF THE INVENTION

As people age, many factors tend to cause either a slow or rapid decline in their walking ability. Aids for walking have long been available to those whose mobility is impaired. One such aid the ubiquitous cane which is typically configured to have the form of the letter "J". The curved portion of the cane is typically grasped by the hand of a user so that the user may support a significant portion of his or her body weight on the elongated straight shaft portion of the cane. The bottom end of the cane typically has a circular rubber tip placed thereupon to provide a non-skid interface with the floor or other surface being traversed by the user of the cane.

While the traditional J-shaped cane has been a great help to many users, it has proven greatly inadequate in many situations. Some people have ailments beyond that condition requiring only a single cane. Such people may include a person who has suffered an injury, illness, has arthritis, has undergone a recent medical procedure, or who has any other debilitating condition. Often a person's doctor recommends or insists that he or she use a walker for "safety" as a regular cane does not provide enough support and/or stability. These people typically stop going out (i.e., leaving their homes) as much as they had done prior to the imposition of a walker requirement upon them. In essence, these people stop living life as they used to. A common complaint is that they don't like being seen in public with a walker as they look like an "old cripple". Another common complaint is that the walkers are just too cumbersome and difficult to carry in and out of a car, etc. These people often tend to stay in the home, maybe using a cane and holding onto furniture to get around. Even if these difficulties are overcome, there is still a more severe problem associated with the use of a walker. When a person uses a walker they lose important upper body trunk rotation and arm swing which is a necessary part of a normal, safe gate cycle. Consequently, their walking ability actually tends to regress as a result of walker usage. Their conditions usually worsen and typically, as their condition continues to decline, they fall. There needs to be a solution which overcomes the stigma and logistical difficulties of using a walker yet provides more support and security than does the traditional single cane. The modular support system of the invention provides such support and security and, in addition, promotes upper body trunk rotation and arm swing, thus preserving and improving the gait cycle.

The traditional cane is of little or no use to a user walking on sand or other loose terrain, on ice, on grass or other soft terrain (e.g., a golf course), and in many other environments. In addition, some users suffer from conditions that require differing amounts or styles of support at a particular time. The traditional cane does little, if anything, to accommodate these needs. Still other users require specialized handle styles, special configurations of the cane shaft, and/or specialized requirements for the tip portion of the cane. The needs of these users are not met by conventional canes of the prior art.

Some users also find that a single cane provides sufficient support (and the resulting sense of security) under most circumstances. There are, however, other circumstances where the single cane configuration fails to provide enough support. One example of such a circumstance is the transition of a curb by a person whose arthritis is particularly severe on a particular day. The single point of support offered by the single cane may place the user at risk for a fall. However, a separable cane structure such as that provided by the instant invention provides a temporary second point of support (i.e., a second cane) for use in stepping off or onto the curb. After the curb transition is complete, the user may simply and quickly reassemble the two components of the inventive modular walking support system into a unitary cane structure. However, a user of the walking support system of the present invention may decide how much support he or she needs (i.e., a single support in the home or as bilateral support outside) for safe walking on different surfaces or in different environments. This allows the user much more freedom to get out of their home and to live life to the fullest, feeling secure when walking.

It is believed that the prior art provides no teaching of a modular walking support system having interchangeable head portions (i.e., handles), interchangeable shaft portions, as well as interchangeable tip portions. The prior art has, however, suggested canes and other walking aids which are separable into two similar devices. When only one is required, the two separate parts combine with one another for convenience.

An example is seen in U.S. Pat. No. 1,375,912 for COMBINATION DUPLICATE OR SINGLE CANE OR STICK, issued Apr. 26, 1921 to John T. Huddle. HUDDLE teaches an arrangement wherein the main shaft of one cane is removably contained within the hollow main shaft of the other. Because the mechanics of this arrangement, one cane (i.e., the inner cane) must, by necessity, be smaller in both diameter and length than the outer cane. While, if made from sufficiently strong materials, the difference in diameters may not provide a problem to a user, however the difference in the two cane's length may provide a significant problem. Perhaps most importantly, to separate the HUDDLE cane into two operable portions, the unitary cane may have to be lifted from the ground and certainly, at least the inner section of the cane will not be touching the ground during disassembly. This leads to an unsafe condition where the cane's user may be completely unsupported. The fact that HUDDLE cane requires large movements such as reaching with the arms during assembly and/or reassembly may cause the user to loose his or her balance.

Another example of a two-part cane of the prior art may be found in U.S. Pat. No. 4,556,075 for TWO-IN-ONE QUICK RELEASE CANE, issued Dec. 3, 1985 to William P. Hoffman. HOFFMAN also teaches an arrangement wherein a first cane is housed inside a second cane. This arrangement suffers from all the same deficiencies as the HUDDLE cane discussed hereinabove.

By contrast, the modular walking support system of the present invention, the unified cane-like structure is formed by longitudinally abutting two portions of the cane structure, neither sections being enclosed by the other. This allows both sections of the cane to remain in firm, operative contact with the ground during the disassembly and reassembly operations. This feature provides significantly improved safety to the user of the cane as he or she is never without the support of at least one of the cane sections. This inventive structure with its inherent advantages is seen to overcome the many shortcomings of canes of the prior art.

Persons who have suffered an injury, illness, have arthritis, have undergone a recent medical procedure, or who have any other debilitating condition may find that separating the two parts of a cane of the prior art requires strength and dexterity beyond his or her capabilities. One embodiment of the walking support system of the present invention includes a mechanical arrangement to assist in separating the joined sections. This as well as other features of the modular walking support system of the present invention are not shown in the prior art.

None of the above patents, taken either singly or in combination, is seen to describe the instant invention as claimed.

SUMMARY OF THE INVENTION

The present invention provides a reconfigurable, modular walking support system featuring a variety of individual head portions (i.e., handles or grips), a variety of central shaft configurations, and a variety of interchangeable tip portions. In one embodiment of the walking support system, the cane or other structure formed from the interchangeable components of the invention is easily, manually separable into two functional, substantially identical walking support units. Such a separable or "two-in-one" structure is suitable for independent use by those who are either permanently or temporarily debilitated by reason of injury, illness, congenital condition, and other influences. The two separated portions of the two-in-one walking support are readily reassemblable into a unitary walking support when two independent walking supports are no longer required.

Several embodiments of the separable, two-in-one walking support are provided. For persons who are debilitated and who may possibly lack either the strength or dexterity to separate two-in-one canes, one embodiment of the present invention provides features assisting such persons in separating the walking support by lessening the force which must be applied to separate the two parts thereof.

Also, the manner of mutual attachment and separation is such that as the two-in-one walking support is being separated into the two independent parts, both parts can remain in contact with the ground. This characteristic reduces requirements for balance which otherwise might be required of a user when separating the two components of other prior art canes. Negotiating curbs and uneven terrain exemplify situations requiring assistance to balance and requiring bilateral support. Also, the separated parts are immediately operative since they are in contact with the ground prior to, during, and immediately after separation.

The novel waking support system may also provide amenities in addition to ready separation into two independently usable parts. Indicia such as an identification plate may be provided which bears identification of the owner, as well as advising important medical data to those who may offer medical assistance should the latter become necessary.

Containers may be formed in the cane to store personal articles and medicaments.

An integral alarm may be provided to sound an audible alarm for summoning assistance in the event of the user falling or becoming the victim of a crime.

A locator system may be provided with the novel walking support system to assist in locating the walking support in the event it is mislaid by its user or by another.

It will be recognized that many other devices, gadgets, and/or accessories having utility to a particular user may be attached to or built into the inventive modular walking support system.

The exterior surface of the walking support system is preferably colored in one or in any combination of a variety of colors. Optionally, indicia such as images of flowers, animals, geometric patterns, or symbols which are thematically linked to events such as holidays may also be placed on the surface. Adornment including such coloring and images, patterns, or symbols, enables the cane to acquire status beyond the ordinary connotation as a symbol of impairment. Consequently, usage and acceptance of canes may become more widespread. More widespread acceptance may encourage usage, thereby decreasing the likelihood of falls and injuries.

Accordingly, it is one object of the invention to provide a modular walking support system having a variety of interchangeable heads (i.e., handles), shafts, and or tips from which a completely customized cane or other walking support structure may be formed.

It is another object of the invention to provide a modular walking support system that provides a number of solid or hollow shafts in differing lengths with optional bends and offsets formed therein.

It is a further object of the invention to provide a modular walking support system that provides a shaft having an adjustable length.

It is an additional object of the invention to provide a modular walking support system that may be easily separated into two, independently functioning canes or similar walking support structures, the two sections being readily reunitable into a single, unitary walking support structure.

It is a still further object of the invention to provide a modular walking support system that provides a mechanism for augmenting the manual force required to separate the two sections of the walking support system.

It is a further object of the invention to assure that a user's hands are in position to grasp and control both sections of the walking support system when the sections are fully separated.

Still another object of the invention is to provide a walking support system carrying an identification plate enabling identification of the user and of medical data important to those assisting the user.

An additional object of the invention is to provide a modular walking support system that includes integral storage for small articles.

It is again an object of the invention to provide a modular walking support system having an attached alarm for summoning assistance when required.

It is yet another object of the invention to provide a modular walking support system providing ways to attach to or include within the walking support system a wide variety of accessories, devices, and gadgets.

It is an additional object of the invention to provide a modular walking support system having a compartment to hold batteries for powering electrically powered accessories.

It is a further object of the invention to advance the status of a cane beyond being a symbol of impairment, and to actively promote more widespread acceptance and usage thereof.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
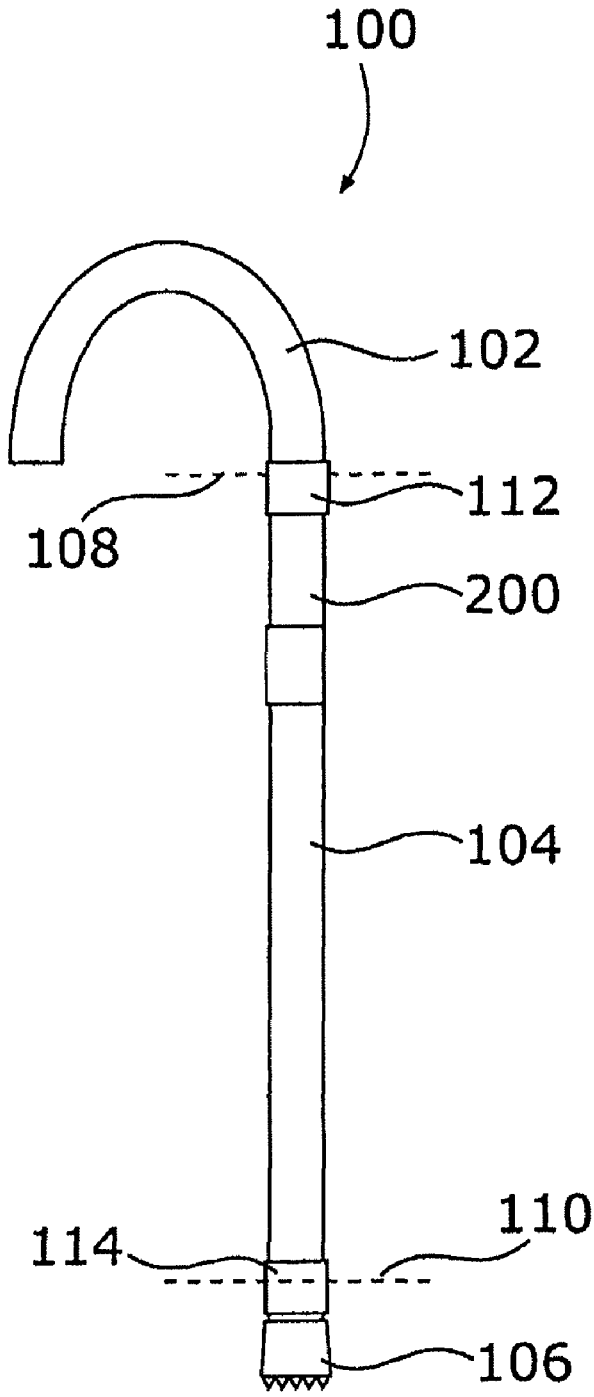
FIG. 1 is a side elevational schematic view of a generic cane-like structure of the modular walking support system of the invention.

The two-in-one walking support system of the present invention provides myriad combinations of interchangeable components which, when assembled, provide a customized, separable walking support which may take the form of several traditional walking support aids. For example, the walking support system of the invention may indeed take the form of a traditional J-shaped cane. However, it may readily be reconfigured into a walking stick, or a simple crutch-like support. In each case, the separable nature may be maintained so as to provide, when required, two independently functioning portions of the walking support system, regardless of the selected configuration. A number of interchangeable, add-on components and accessories may be combined to create a truly custom, separable walking support system to meet the specific support needs of a particular user in a specific environment.

The separable walking support system has three major components: a head or handle portion, a shaft portion, and a lower tip portion. As will be described in detail hereinbelow, a wide variety of interchangeable options are available for each of these three portions of the inventive walking support system. In addition, a wide variety of add-on options and features are available to further customize and adapt the inventive walking support system to function properly in a particular operating circumstance or environment. The three portions of the walking support system of the invention are shown schematically in FIG. 1, generally at reference number 100. Head or handle portion 102 is disposed at a proximal end of elongated shaft portion 104. A tip portion 106 is disposed at a distal end of elongated shaft portion 104. Head portion 102 is separated from shaft portion 104 at line 108. Tip portion 106 is separated from shaft portion 104 at line 110. For purposes of illustration, head portion 102 is depicted as a traditional J-shaped handle and tip portion 106 is shown schematically as comprising a traditional rubber cane tip. It will be recognized that, as will be discussed in detail hereinbelow, that both head portion 102 and tip portion 106 may assume a number of different forms.

Figure 2A:
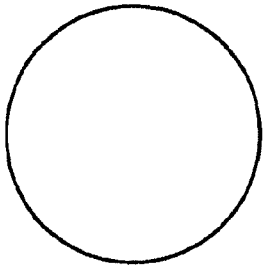
FIGS. 2*a*-2*h* are top plan, cross-sectional views of the shaft portion of the modular walking support system of FIG. 1 showing a range of possible shapes therefor.
Figure 2B:
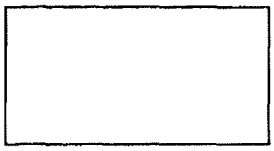
Figure 2C:
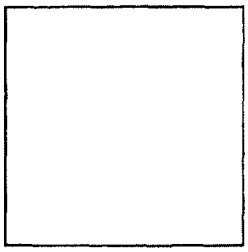
Figure 2D:
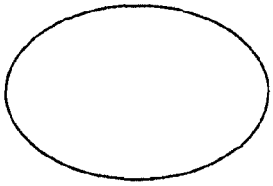
Figure 2E:
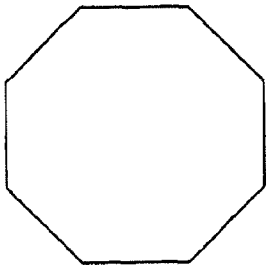
Figure 2F:
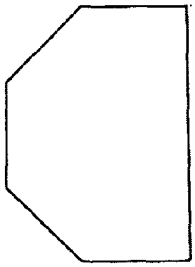
Figure 2G:
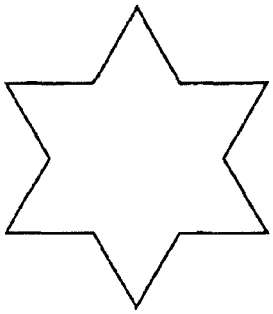
Figure 2H:
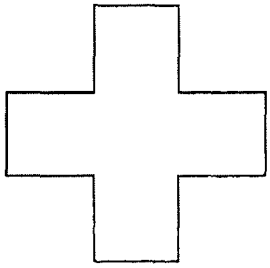

Shaft portion 104 is typically an elongated, substantially straight, rectilinear structure having a substantially uniform cross section. The cross sectional shape of shaft 104 may be characterized as circular (FIG. 2*a*), rectangular (FIG. 2*b*), square (FIG. 2*c*), oval (FIG. 2*d*), polygonal (either regular (FIG. 2*e*) or irregular (FIG. 2*f*)), star (FIG. 2*g*), cruciform (FIG. 2*h*) or any other suitable shape or combination of shapes. It will be recognized that the combination of cross-sectional area and material strength must be sufficient to support the necessary portion of a user's weight when shaft portion 104 is in use in the walking support system 100.

Typically, shaft portion 104 is hollow but it is also possible to construct shaft portion 104 as a solid structure. Shaft portion 104 may be constructed from aluminum, steel, plastic, or wood, aluminum or a suitable plastic generally being preferred from weight, ease of fabrication, as well as cost perspectives. It will be recognized that other materials may also be used and the invention is, therefore, not considered limited to a particular material chosen for purposes of disclosure. Regardless of the cross-sectional geometry or chosen material, shaft portion 104 may be longitudinally separable into two portions in accordance with one embodiment of the instant invention. These separate portions are not shown in FIG. 1. Rather, portions 104*a* and 104*b* may be seen in FIGS. 7-11 and will be described in detail hereinbelow.

Shaft portion 104 may be provided in a number of different fixed lengths to properly meet the need to construct walking supports of the correct length for users of differing heights. In alternate embodiments, shaft portion 104 may be provided as an adjustable length shaft as will be described in more detail hereinbelow.

Figure 3C:
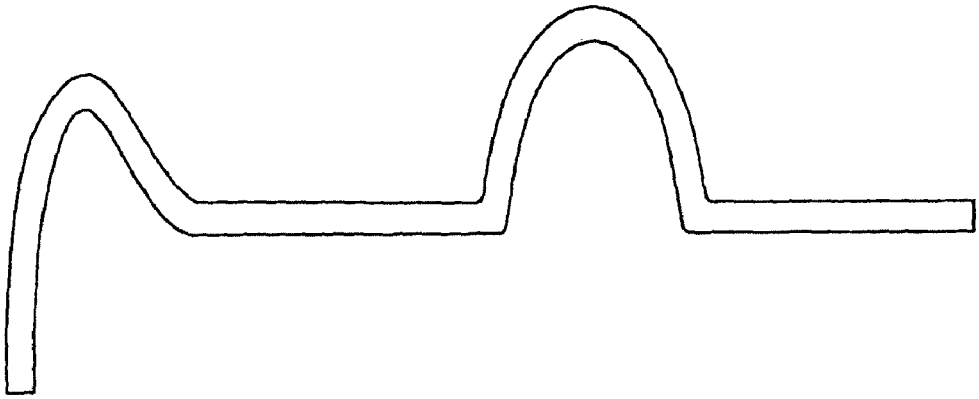
FIGS. 3*a*-3*c* show side elevational views of a portion of the shaft of the walking support system of FIG. 1 having different bends and offsets formed therein.
Figure 3B:
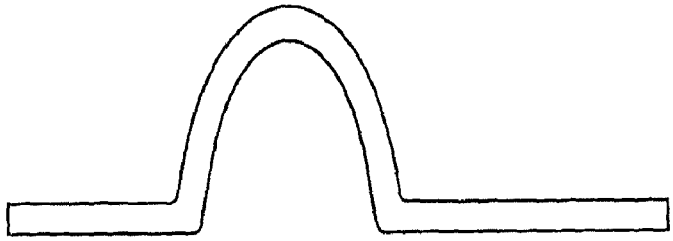
Figure 3A:
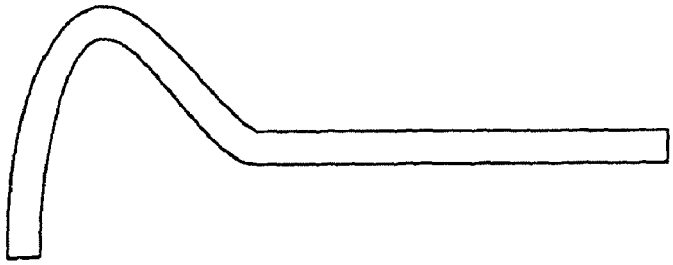

In addition to substantially straight configurations, shaft portion 104 may also be supplied with one or more bends or offsets. Three possible configurations are shown in FIGS. 3*a*, 3*b*, and 3*c*, respectively. The uses and advantages of such bends and offsets will be recognized by those of skill in the art and such advantages are not further discussed herein. It will also be recognized that many other configurations of bends and offsets may be used and the invention is not considered limited to the three examples chosen for, purposes of disclosure. Rather, the invention is seen to encompass any and all possible combinations of bends and offsets within shaft portion 104.

Shaft portion 104 has connectors 112, 114 disposed at its proximal and distal ends, respectively. Connectors 112, 114 are designed and adapted to allow interchangeable attachment of a variety of different head portions and tip portions, respectively. The connectors 112, 114 may consist of screw thread, a twist-lock (e.g., bayonet type), or any other suitable reliable connector. It will be recognized by those of skill in the art that a variety of suitable attachment systems are available and any suitable attachment mechanism may be used, the actual attachment system forming no part of the instant invention. It will be recognized that in separable embodiments of the invention that connectors 112, 114 must be configured to independently joint respective separable portions of both head portion 102 and tip portion 106 to respective positions of shaft 104.

Figure 4:
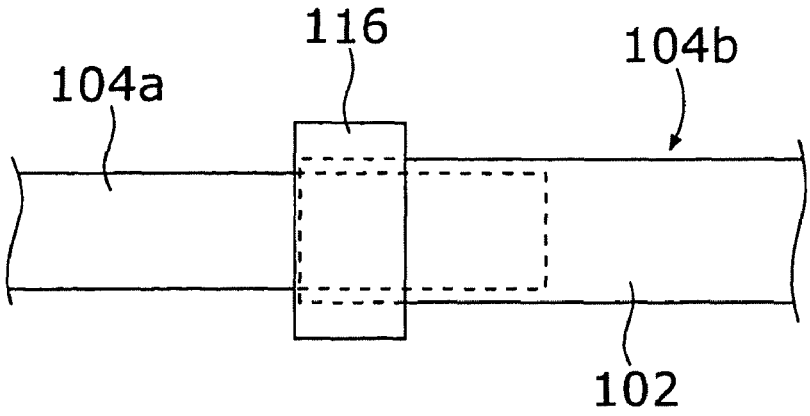
FIG. 4 is a schematic representation of an adjustable length embodiment of a shaft portion suitable for use with a walking support system such as that of FIG. 1.

Referring now to FIG. 4, there is shown a schematic representation of an adjustable length embodiment of shaft portion 104. Shaft portion 104 may be made length adjustable by providing suitable coaxial shaft portion sub-sections 104*a*, 104*b* and a suitable securing mechanism 116 for holding shaft portion sub-sections 104*a*, 104*b* in a suitable, predetermined relationship, thereby creating a desired overall length for shaft portion 104. Securing mechanism 116 may be the familiar friction mechanism used extensively on camera tripods and the like. Another possible securing mechanism 116 is a set screw, not shown, engaging inner shaft portion sub-section 104*a*. Because it is necessary to reliably maintain the predetermined, adjusted length of shaft portion 104, a securing mechanism such as a spring-loaded plunger, not shown, which is engaged in one of a predetermined number of holes, not shown, may advantageously be used. Such securing arrangements; commonly used to adjust the length of metal crutches, not, shown, or height of walker legs, not shown, are believed to be well known to those of skill in the art are not further described herein.

Figure 5A:
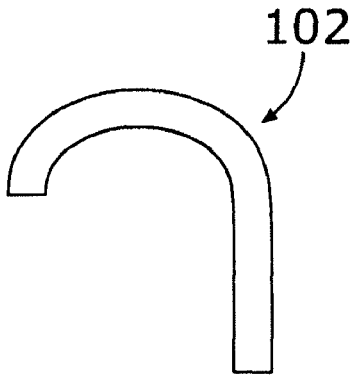
FIGS. 5*a*-5*g* are side elevational schematic views of various head configurations suitable for use with the modular walking support system of the invention.

Referring now to FIGS. 5*a*-5*g*, there are shown several possible configurations of head portion 102 of walking support system 100 (FIG. 1). FIG. 5*a* is a side elevational view of the common J-shaped head portion 102.

Figure 5B:
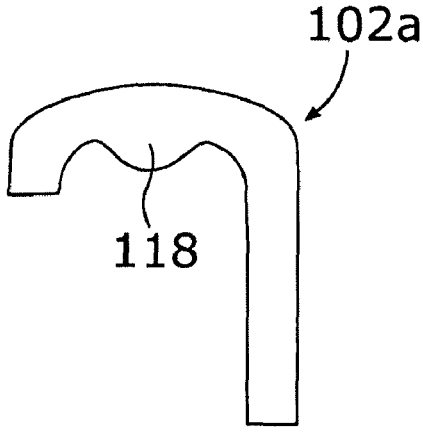

FIG. 5*b* is a side elevational view of a first alternate embodiment 102*a* of head portion 102. The common J-shape head 102 (FIG. 5*a*) is modified to include an enlarged portion 118 at a lower central region of the head portion 102*a*.

Figure 5C:
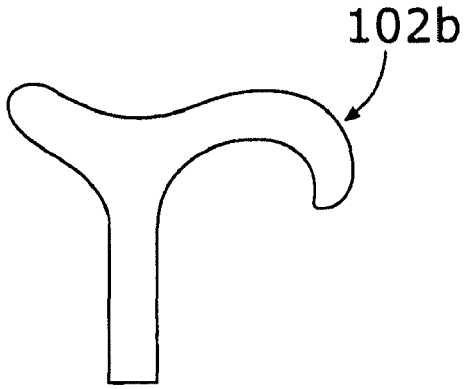

FIG. 5*c* is a side elevational of a second alternate embodiment 102*b* of head portion 102. This second alternate embodiment 102*b* is known to those of skill in the art as an R-shaped or T-shaped handle.

Figure 5D:
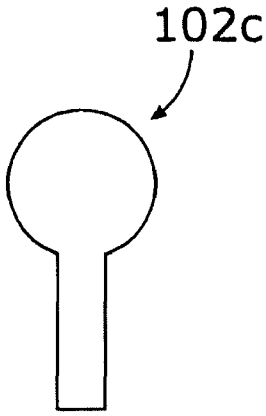

FIG. 5*d* is a side elevational view of a bulbous head 102*c* as is commonly found at the upper end of a walking stick.

Figure 5E:
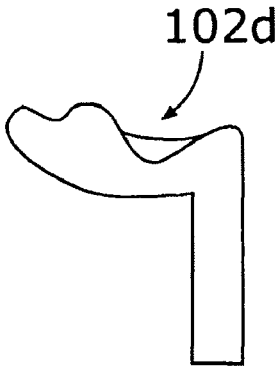

FIG. 5*e* is a side elevational view of a commercially available orthopedic grip 102*d* which has a shape more readily gripped by a user suffering from arthritis or the like.

Figure 5F:
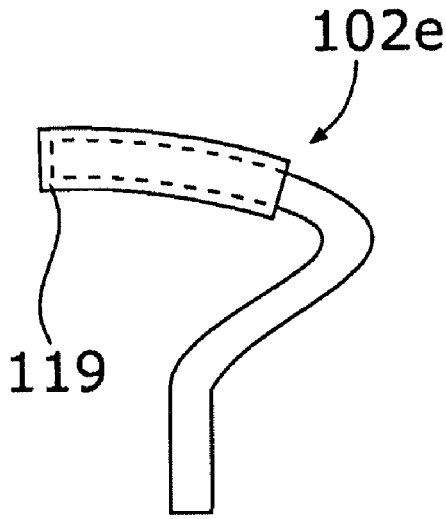

FIG. 5*f* is a side elevational of yet another alternate embodiment of a head 102*e*. The gripping portion of head 102*e* includes a resilient sleeve 119 to provide comfort to the user thereof.

Figure 5G:
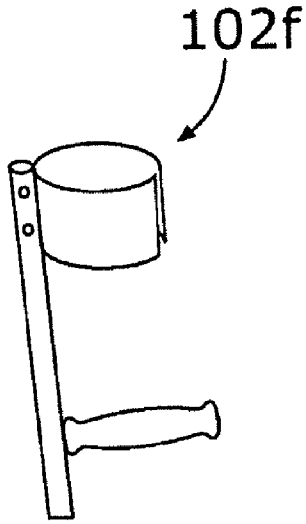

FIG. 5*g* is a side elevational view of a forearm crutch head portion 102*f* which may also be used interchangeably with the modular walking support system of the invention.

It will be recognized that many additional sizes and styles of head portion 102 may be provided and utilized in the modular walking support system of the invention. Consequently, the invention is not considered limited to those exemplary head portions 102-102*f* chosen for purposes of disclosure. Rather, the invention is seen to encompass any and all size and shape variations thereof that may be suitable for supporting a user while walking.

The ability to select and utilize different head portions 102 gives a user of the inventive walking support system many choices to meet particular support needs. A user recovering from a broken leg may, for example first use head portion 102*f* (FIG. 5*g*) for a period of time. Later in his or her recovery, a different head portion 102 may become more suitable. In a second example, an arthritis sufferer may have "good" days and "bad" days. One particular head portion 102 may be suitable for use on a good day, another more suitable for use on a bad day. In a third example, a user may choose head portion 102*c* (FIG. 5*d*) on one day for a casual stroll and a different, more conventional cane-type head portion 102 on a different day for a different type of walk.

It will also be recognized that a grip cover and/or padding may optionally be added to any of the top portions 102 of FIGS. 5*a*-5*g*. Suitable materials include, but are not limited to: rubber, fabric, wool, leather, and a foamed polymer (either open or closed cell). Any of the chosen grip covering may optionally have an additional resilient coating, typically neoprene or the like.

As is the case with head portion 102, the inventive, modular walking support system 100 (FIG. 1) features a number of options for tip portion 106 (FIG. 1). Conventional circular cross-section rubber tips have been used on canes, crutches, and walkers for many years. While such tips are suitable for solid, level terrains, they fail to provide a desired/required level of security to a user of a walking support on other terrains. To overcome this limitation, the modular walking support system of the present invention provides a variety of interchangeable options to replace such simple rubber tips of the prior art.

Figure 6A:
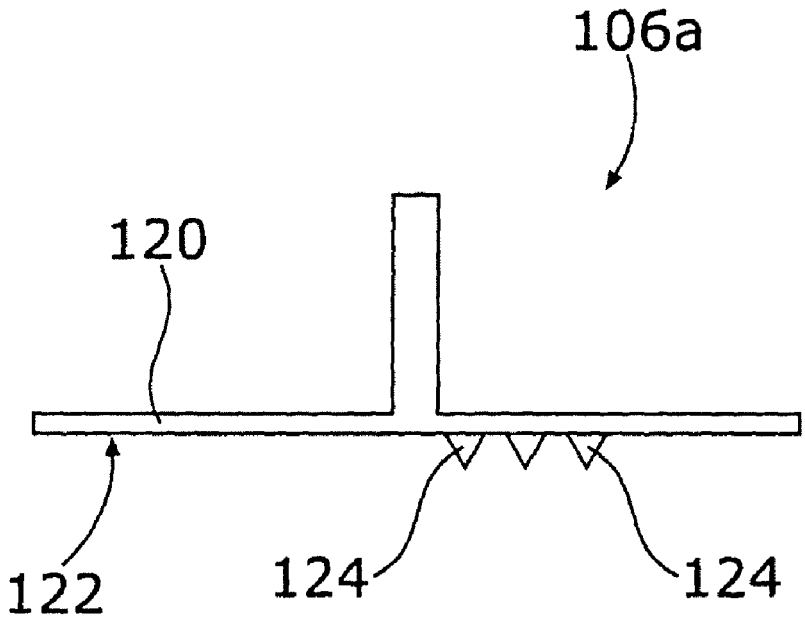
FIGS. 6*a* and 6*b* are side elevational schematic view of an ice-gripping tip and a four-prong tip assembly suitable for use with the modular walking support system of the invention.
Figure 6B:
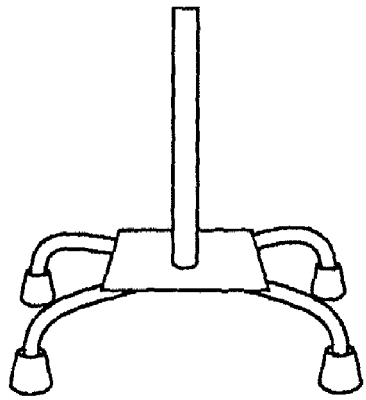

Referring now to FIGS. 6*a* and 6*b*, there are shown side elevational views of two optional tip portions 106 suitable for use with the modular inventive walking support system. FIG. 6*a* shows a tip portion 106*a* having an enlarged flat region 120 adapted to spread the weight of a user over a much larger area than the conventional rubber tip of tip portion 106 (FIG. 1). Such an arrangement as shown in FIG. 6*a* may be useful in sand or when traversing other soft terrain where the user's weight, when concentrated in the smaller diameter conventional rubber tip, causes the tip portion 106 to sink into the terrain. Tip portion 106*a* may, optionally have a gripping pattern 124 disposed on a lower surface 122 of flat region 120. Gripping pattern 124 may be one or more spikes, a pattern of ridges, or any other textured pattern, all schematically represented by pattern 124, suitable for frictionally engaging the terrain being traversed by a user. For example, course spikes may be suitable for use on grass such as a golf course or the like. Finer spikes may be more suitable for gripping an icy surface, etc. It will be recognized that a large number of different patterns 124, each suitable for a particular environment, may be created and the invention is, therefore, seen to encompass any and all such patterns.

A traditional four prong tip attachment is shown in FIG. 6*b*. Such four prong arrangements are known to those of skill in the art and are believed to offer stability advantages to users under certain circumstances.

It will be recognized that tip portion 106 may be modified to include any known tip feature such as wheels, skids, other numbers of prongs, collapsible prongs, shock absorbing mechanisms, spikes, or other terrain-gripping devices. Other tip constructions which may not necessarily conform to the terrain may also be used. Consequently, the invention is not considered limited to the tip portion examples chosen for purposes of disclosure.

One of the most important features of the inventive, modular walking support system 100 (FIG. 1) is seen to be the splitable or two-in-one feature wherein a single unitary cane-like structure may be easily divided into two, independently functioning portions. A variety of mechanisms may be used to provide such functionality.

Figure 7:
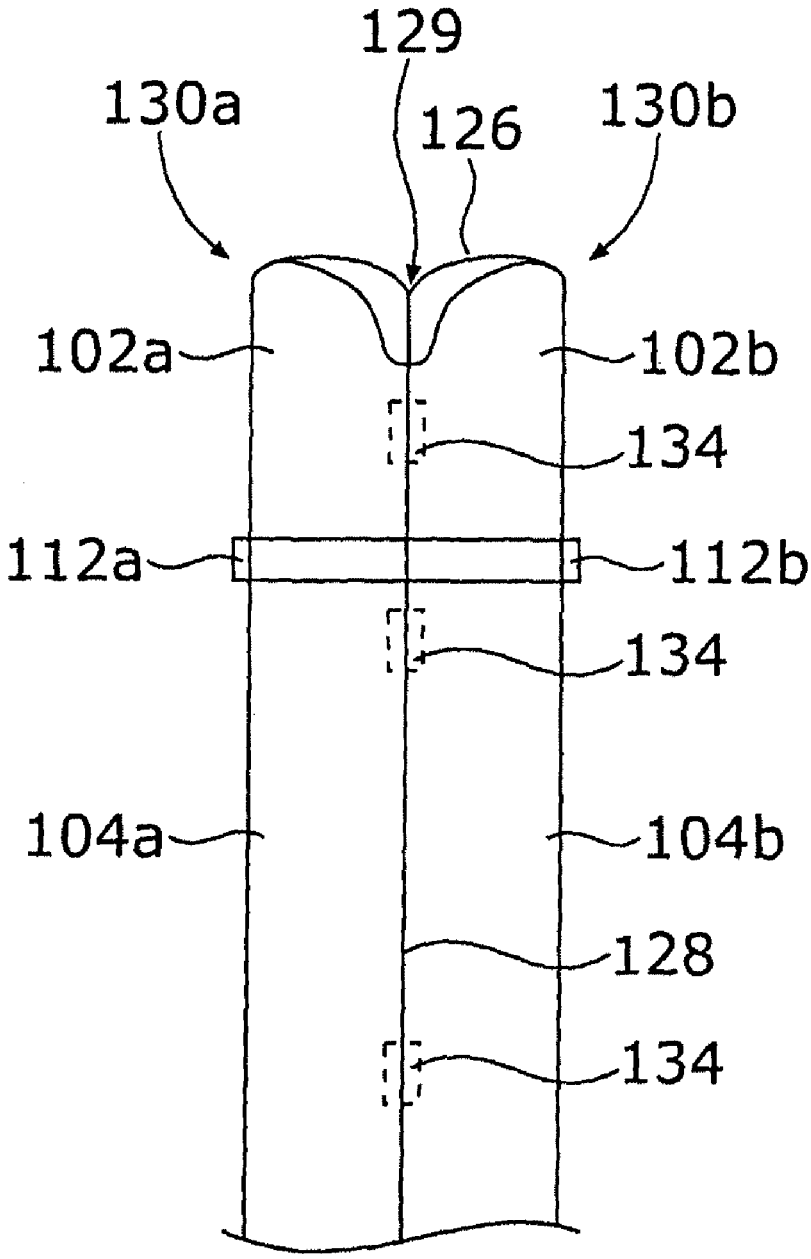
FIG. 7 is a front, elevational schematic view of a separable embodiment of the inventive modular walking support system in a cane-like configuration.

Referring now to FIG. 7, there is shown a front elevational schematic view of a first embodiment of an upper portion of a separable cane-like structure in accordance with the present invention. Head portions 102*a*, 102*b* and shaft portions 104*a*, 104*b* are typically mirror images of one another. Connectors 112*a*, 112*b* independently secure respective ones of head portions 102*a*, 102*b* and shaft portions 104*a*, 104*b* to one another thereby forming cane portions 130*a*, 130*b*. Tip portions, not shown in FIG. 7, may or may not be independently joined to shaft portions 104*a*, 104*b* by suitable connectors. Cane portions 130*a*, 130*b* are aligned and longitudinally abutted against each other along center line 128. Inside regions of respective head portions 102*a*, 102*b* are substantially flat and exterior surfaces proximate the top 126 of the head portions 102*a*, 102*b* are formed such that when cane portions 130*a*, 130*b* are abutted, a groove 129 is formed between head portions 102*a* and 102*b*. An optional thin layer of resilient material, not shown, may be added to the abutment faces formed along line 128 in both cane portions 130*a* and 130*b* to provide enhanced mating of cane portions 130*a*, 130*b* with one another.

Connectors 134 disposed along mating surfaces of cane portions 130*a*, 130*b* are adapted to secure cane portions 130*a*, 130*b* to one another when the cane structure in an assembled, unitary mode. Connectors 134 may be snap structures, hook-and-loop, material, magnets, or any other similar mechanism such as interlocking grooves which provides necessary retentive force on cane sections 130*a*, 130*b* when a single, unitary mode is desired. Connectors 134 must, however, allow easy manual separation of cane sections 130*a*, 130*b* when the two-in-one, separated configuration is required.

In operation, downward pressure in the area of groove 129 forces connectors 134 apart thereby separating cane portions 130*a*, 130*b* and allowing their independent use. Optionally, an additional grove located on the underside of head portions 102*a*, 102*b* for example, groove 198 (FIG. 11) may receive augmenting upward pressure to facilitate separation. The underside groove 198 may be used for separation while the hand or hands remain in a grasping position on one or both the head portions 102*a*, 102*b*. While groove 198 is typically used to augment separating force applied to upper groove 129, it may function independently thereof. In other words, it is possible to separate the walking support structure using only bottom groove 198. During the separation process, both cane portions 130*a*, 130*b* remain in contact with the floor or other surface being traversed by the cane's user. For many users, the slight pressure required to manually separate the sections 130*a*, 130*b* provides little or no problem. To other users, however, even this amount of pressure is problematic and another approach to cane section separation is required.

While a modular walking support structure having interchangeable head portions 102 and/or tip portions 106 has been used for illustrating the two-in-one structure of the invention, it will be recognized that the two-in-one feature may be implemented independently of such a modular arrangement (i.e., as a pair of one piece structures mated one to the other). The invention is, therefore, not considered limited to a modular two-in-one walking support system but is seen to encompass non-modular, separable versions of canes and the like.

Figure 8:
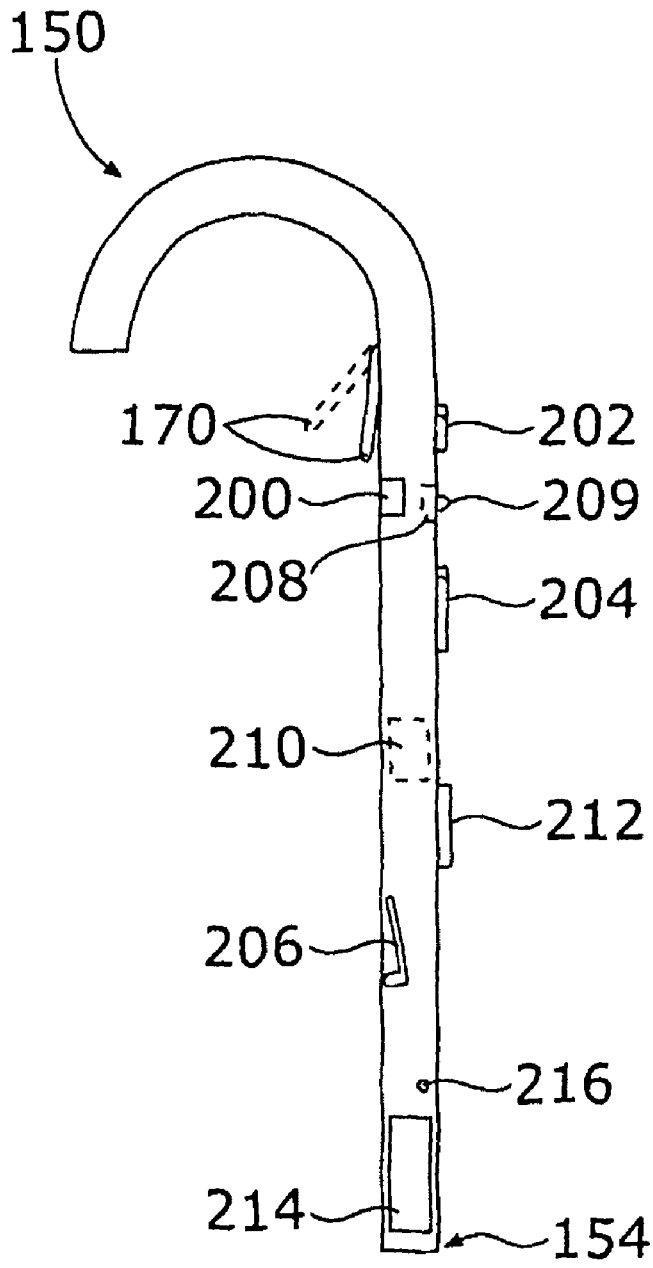
FIG. 8 is a side elevational schematic view of a mechanically assisted separable embodiment of the modular walking support system of the invention.
Figure 9:
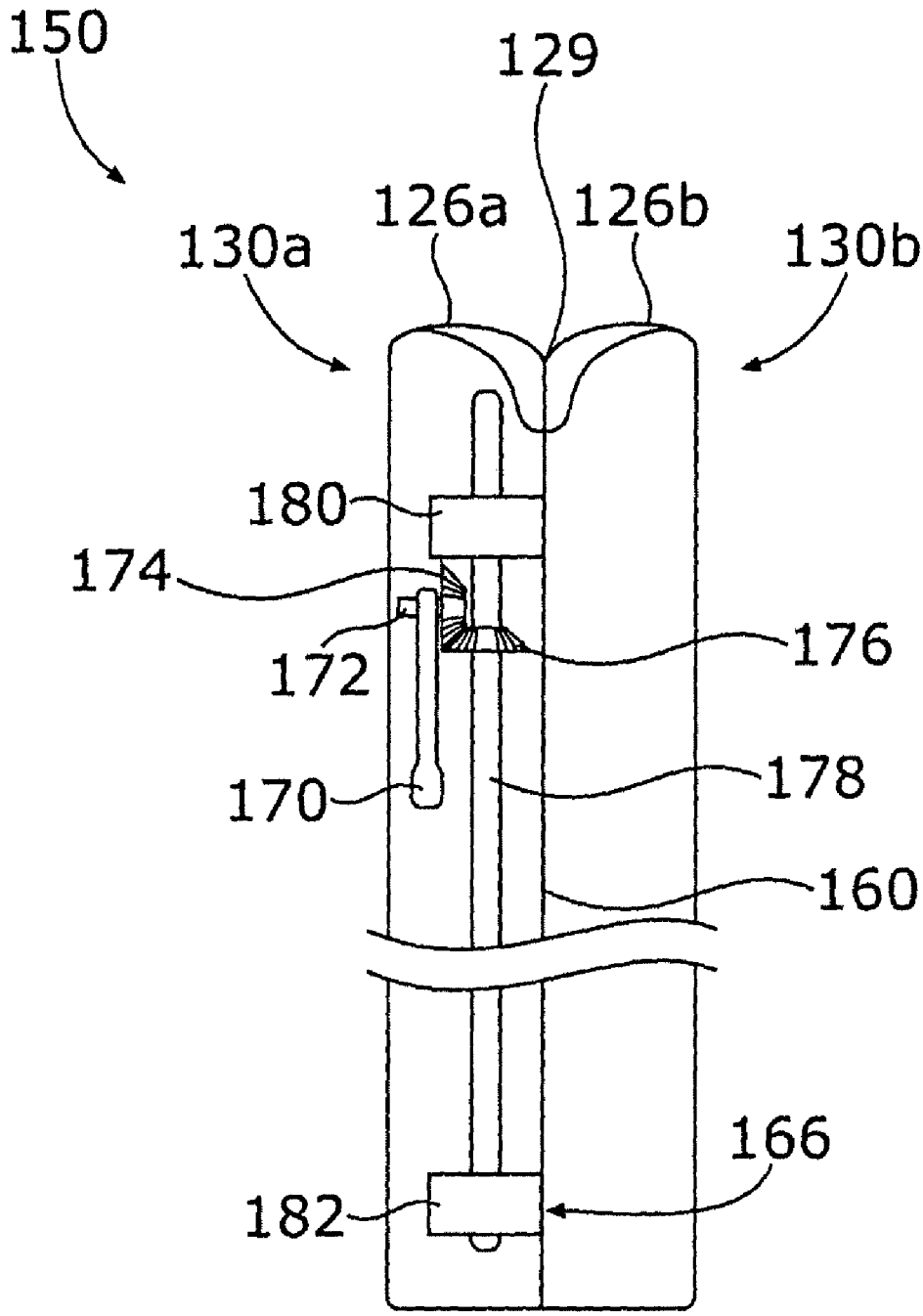
FIG. 9 is a front, elevational view of the mechanically assisted separable embodiment of the modular walking support system of FIG. 8 in a unified configuration and showing the internal separation mechanism.
Figure 10:
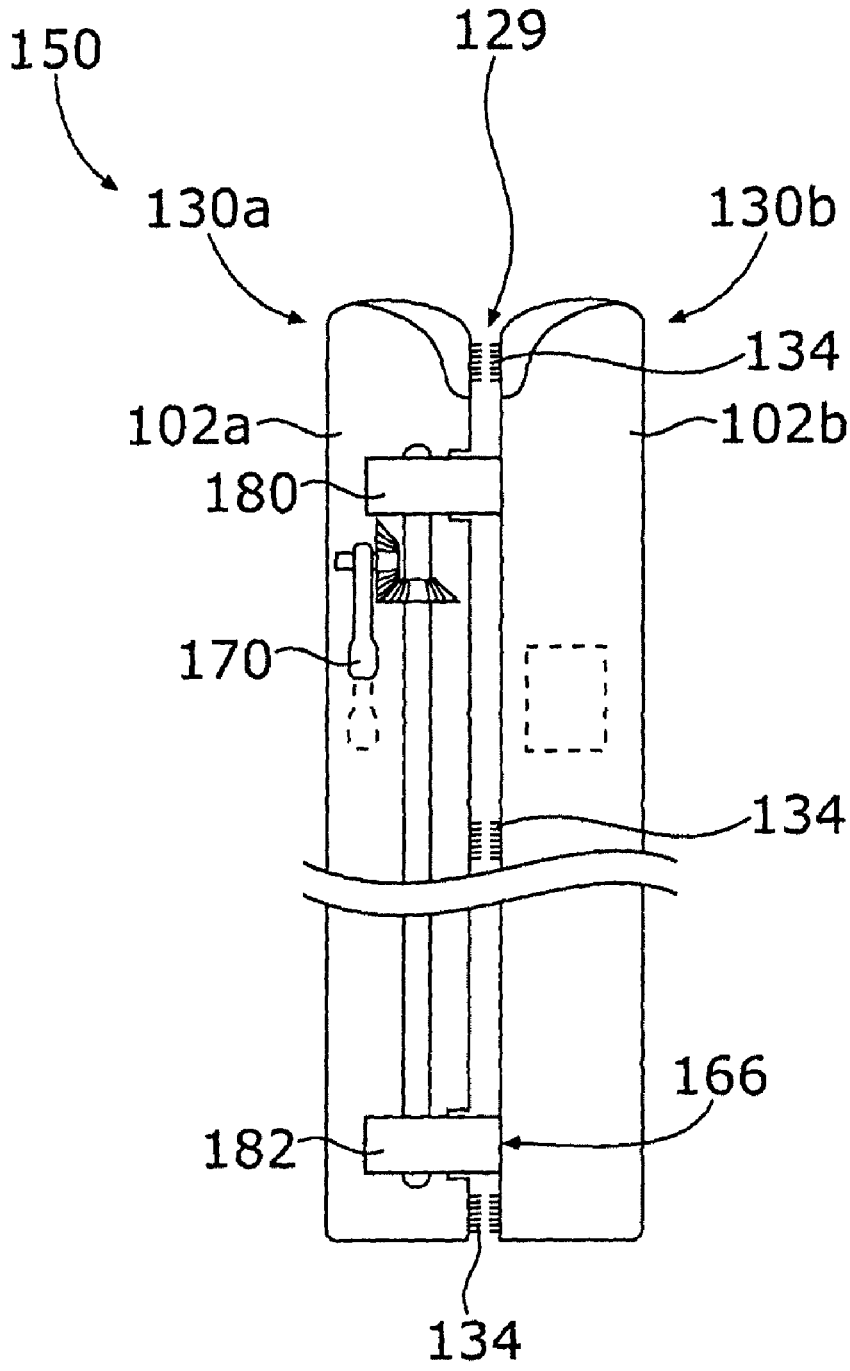
FIG. 10 is a front, elevational view of the mechanically assisted separable embodiment of the modular walking support system of FIG. 9 in a partially separated configuration.
Figure 11:
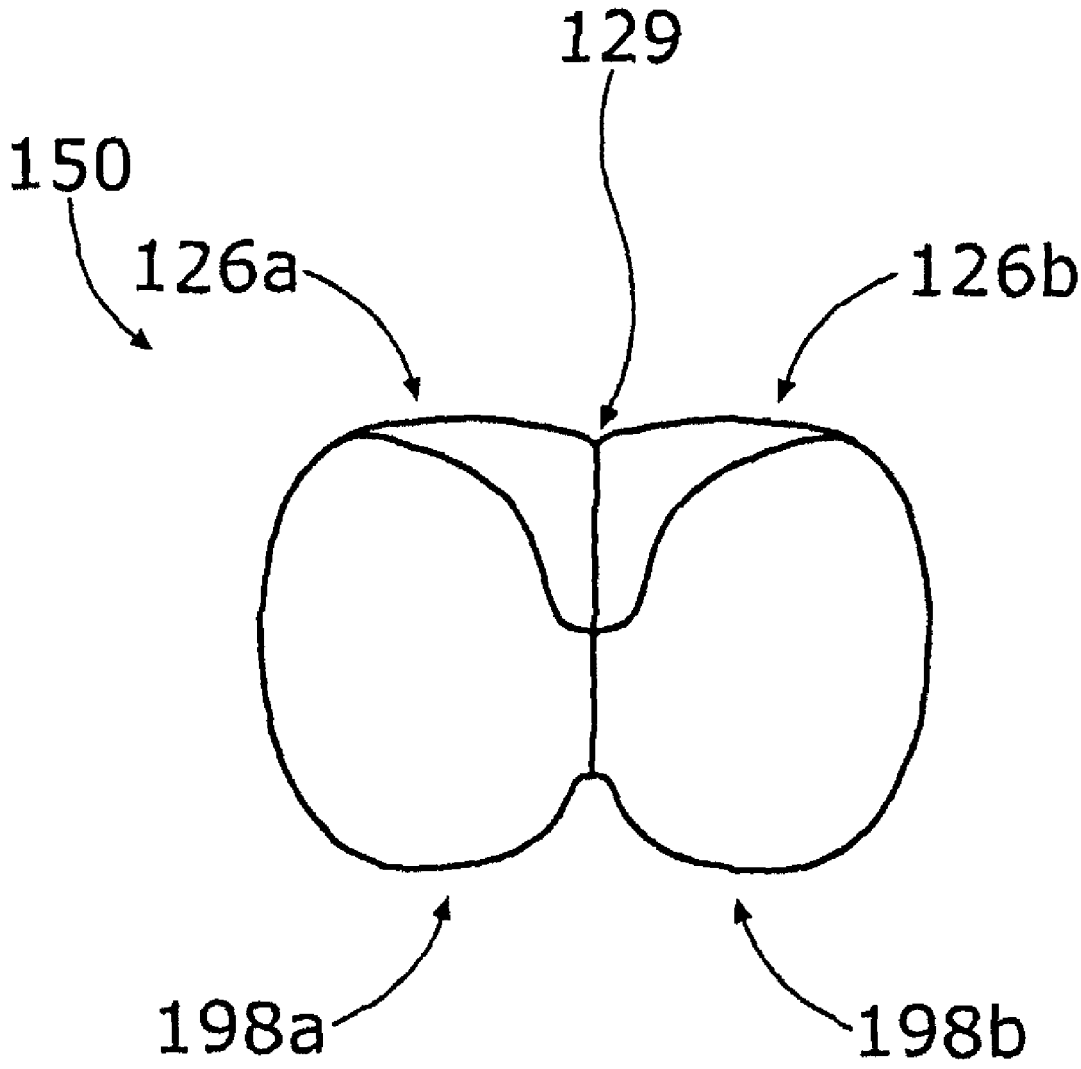
FIG. 11 is a top, plan view of the walking support system of FIG. 8 in a unified configuration.

Referring now to FIGS. 8, 9 and 10, there are shown side (FIG. 8), and front elevational views of cane 150, unified, (FIG. 9), and during the first stages of separation (FIG. 10), respectfully, of an alternate embodiment of the walking support system of FIG. 7. In this embodiment, a mechanism has been added to facilitate the separation of cane sections 130*a*, 130*b* by users lacking the strength to accomplish manual separation as described hereinabove.

In the embodiment of FIGS. 8-10, an externally accessible lever 170 and a connected internal mechanism urge sections 130*a*, 130*b* apart when lever 170 is moved from a normal position, shown in solid lines in FIG. 8. In the normal position, lever 170 avoids separating motion, whereas as it moves to the separating position shown in broken lines, lever 170 acts on intermediate components to urge sections 130*a*, 130*b* apart.

The intermediate components are shown in FIGS. 9 and 10. Lever 170 is rotatably supported on a shaft 172 suitably journaled within section 130*a*. A gear 174 fixed to shaft 172 engages another gear 176 mounted on an elongated second shaft 178. Shaft 178 is also suitably journaled within section 130*a*, and bears two eccentrically disposed cam members 180, 182. Turning now to FIG. 10, when lever 170 is raised into the separated position (shown in solid lines in FIG. 10, with the normal position being shown in broken lines), cam members 180, 182 rotate such that they press against abutment face 166 of section 130*b*, thereby overcoming adhesion of fasteners (e.g., hook and loop material) 134 and achieving at least an initial degree of separation between sections 130*a*, 130*b*. Cam members 180, 182 may be of unequal diameter or other dimension such that they do not act equally when separating sections 130*a*, 130*b*. Rather, if for example, cam member 180 pushed section 130*b* farther away from section 130*a* than did cam member 182, then sections 130*a*, 130*b* would be farther from one another at the top than at the bottom. This condition may be exploited when removing one section 130*a* or 130*b* from a protective cap, not shown, enveloping the distal end 154 of both sections 130*a*, 130*b*, in those embodiments wherein such a protective cap is provided.

FIG. 10 is exaggerated in that hook and loop material 134 is shown fully separated only to emphasize that both sections 130*a*, 130*b* bear only one type (hooks or loops) of the hook and loop material 134. It should be understood that cane 150 may be arranged so that tenuous connection by contact of hook and loop material 134 occurs even when cam members 180, 182 have partially separated sections 130*a*, 130*b*. Final separation may then be accomplished by grasping sections 130*a*, 130*b* with the fingers and thumb of each hand (not shown) engaging one section 130*a*, 130*b* by grooves 126*a*, 126*b* and 198*a*, 198*b* as may be seen in FIG. 11. Grooves 126*a*, 126*b* are formed on the exterior, top surfaces of sections 130*a*, 130*b*, respectively. Groove 129 is located at the top of cane 150 and groove 198 is located in the bend below the handle. The user may thus encircle appropriate portions of section 130*a* or 130*b* with the fingers and thumb of one hand at the moment of final separation of sections 130*a*, 130*b*. This is extremely useful when circumstances demand maximal balance and bilateral support. With sections 130*a*, 130*b* almost separated, cane 150 may be placed with distal end 154 contacting the ground, not shown. When grasped as described above, each hand will encircle and grasp one section 130*a* or 130*b*8 independently of the other. Distal ends of both sections 130*a*, 130*b* contact the ground, so that immediate symmetrical support for both hands is facilitated.

Whether the sections are joined or separated, cane 150 is unencumbered by projections and other unnecessary bulky structure, and is thus readily wielded as one cane or as two canes.

As mentioned hereinabove, the inventive walking support system 100 (FIG. 1) or 150 (FIG. 8) may include many add-ons, as well as self-contained devices and accessories.

While walking support system 150 is referenced for purposes of disclosure, most if not all of the features, accessories, add-ons, etc. may be applied as well to the walking support system 100 of FIG. 1.

Refer now again to FIGS. 1 and 8. For example, the exterior of any of the head portion 102, shaft portion 104, and tip portion 106 may be finished in a decorative fashion. Distinctive colors, not shown, and/or decorations may be placed on the modular walking support system 100. Changeable overlays, not shown, may be used in keeping with a particular holiday or season. In addition, the walking support system 150 may be adorned indicia corresponding to an image of an object or of a geometric pattern or design. In a further option, the indicia may correspond to a symbol thematically associated with an activity or belief. In the example depicted, a golf club is simulated by indicia 206. These adornments 206 will potentially create an image of stylishness associated with walking support system 150 that will tend to overcome traditional implications associated with canes, walkers, and other ambulatory aids.

The walking support system 150 may be equipped with an identification plate 200 bearing indicia. Such indicia may contain the name and address of the walking support system's owner, medical information such as medical conditions, allergies, etc. useful to medical personnel in the event of an emergency or illness, or any other useful information.

Two storage compartments 202, 204 are optionally attached externally to walking support system 100. If desired, compartments 202, 204 could be formed wholly or partially within sections 302*a*, 302*b* (FIG. 9). Compartment 202 is of dimensions smaller than those of compartment 204. Compartment 202 may be employed to store medication, such as nitroglycerine pills. Many patients suffering from propensity to heart attacks will benefit greatly to have such important medication so close at hand. Compartment 204 is larger, and may be employed to store larger personal articles such as eyeglasses, keys, lipstick, tissues, protective substances such as sunscreen (none of these are shown), and the like. Of course, in some embodiments, only one compartment 202 or 204 may be provided. Additional compartments (not shown) may also be provided.

An audible alarm 208 is optionally attached to modular walking support system 150. Alarm 208 may be of the type including an integral battery and a sound generator such as a buzzer or other sound-producing mechanism (not separately shown) as are well known to those of skill in the art. Alarm 206 includes an external operator accessible control, such as button 209, which activates the sound generator or buzzer.

Many other electronic devices may be added to the inventive walking support system 150. They are represented on FIG. 8 as device as internal device 210 or external device 212. All are well known to those of skill in the art and bear no further explanation herein. Devices 210 and/or 212 include, but are not limited to, a radio, tape, or MP3 player; a locator system responsive to an externally generated command to help locate a mislaid walking support system; a locator beacon to help find a person who may have become confused, disoriented, or lost; one or more flashing lamps serving as decorations or as warning beacons used for twilight or nighttime walking; a built-in or attached flashlight to illuminate the path in front of the user; a holder for a beverage container such as a soda can or bottle, a thermos bottle, or other such container; weights (which may be adjustable) added for therapeutic purposes to help facilitate a proper walking gate; a help-summoning transmitter; and a playback device adapted for providing affirmative messages to the use of modular walking support system 150. When weights are added, they are typically added to tip portion 106.

As has previously been described, various components of the modular walking support system 150 may be supplied in various colors and hues, and/or with decorations, etc. to help overcome the stigma perceived by some users arising from usage of such a device.

While the embodiment of the inventive walking support system 150 as illustrated in FIG. 8 has been used for purposes of disclosure, it will be recognized that any combination of these described features may readily be applied to any other embodiment, for example modular walking support system 100 as shown in FIG. 1.

Several of the aforementioned devices require electrical power for their operation. An internal battery compartment holding batteries 214 may be provided as a central power source for any or all of the electrically powered accessories located within or attached to the inventive modular walking support system. In another alternate embodiment, the internal battery or batteries 214 may be rechargeable with a suitable connection 216 provided on an exterior surface of the modular walking support system for attaching a power pack to recharge the rechargeable batteries 214.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims:

What is claimed is:

1. A two-in-one cane having a predetermined length along its longitudinal axis and being selectively separable into two sections, wherein each one of said sections is independently usable as a cane, and wherein said sections are capable of being united into a single assembly forming a single cane, comprising:

a) a first section comprising a first elongated component having a length substantially equal to said predetermined length, wherein one end of the first elongated component is formed as a first handle with a substantially flat region and a portion that extends substantially perpendicular to the longitudinal axis of the cane, and wherein an opposite end of the first elongated component is formed as a first tip;

b) a second section comprising a second elongated component having a length substantially equal to said predetermined length, wherein one end of the second elongated component is formed as a second handle with a substantially flat region and a portion that extends substantially perpendicular to the longitudinal axis of the cane, and wherein an opposite end of the second elongated component is formed as a second tip; and c) a plurality of connectors spaced apart from each other along the longitudinal axis of the cane that removably secure said first section to and abreast of said second section in generally parallel relationship to one another, wherein the substantially flat region of the first handle and the substantially flat region of the second handle are in abutment with each other when said first section is secured to and abreast of said second section, wherein the plurality of connectors are configured so a user of the cane can separate said first section from said second section by incrementally separating the plurality of connectors along the longitudinal axis of the cane so that the first handle can be separated from the second handle while the first tip and second tip remain abreast of one another.

2. The two-in-one cane of claim 1, further comprising an identification plate bearing indicia corresponding to an identification of the user of said cane, wherein said identification plate is affixed to an exterior surface of said two-in-one cane.

3. The two-in-one cane of claim 1, further comprising an identification plate bearing indicia corresponding to medical data relative to the user of said cane, wherein said identification plate is affixed to an exterior surface of said two-in-one cane.

4. The two-in-one cane of claim 1, further comprising at least one first storage compartment attached to said cane.

5. The two-in-one cane of claim 4, further comprising a second storage compartment attached to said cane, wherein said second storage compartment is of different dimensions than said first storage compartment.

6. The two-in-one cane of claim 1, further comprising an alarm attached to said cane, wherein said alarm includes an external operator accessible from at least one of said first exterior surface and said second exterior surface of said cane.

7. The two-in-one cane of claim 1, wherein at least one of said first exterior surface and said second exterior surface includes surface coloring of a hue other than white.

8. The two-in-one cane of claim 1, wherein said cane bears indicia upon at least one of said first exterior surface and said second exterior surface of said cane.

9. The two-in-one cane of claim 8, wherein said indicia upon the at least one of said first exterior surface and said second exterior surface of said cane comprises an image of an object.

10. The two-one-cane of claim 1, wherein said cane bears indicia corresponding to a thematic symbol upon at least one of said first exterior surface and said second exterior surface of said cane.

11. The two-one-cane of claim 1, wherein said cane further comprises at least one of a locator system, a battery, a battery compartment, a help-summoning transmitter, and an audio playback device.

12. The two-one-cane of claim 11, wherein said audio playback device comprises at least one of a radio, a tape player, a CD player, an MP3 player, and a device for providing positive messages to a user of said cane.

13. The two-in-one cane of claim 1, wherein when the cane is assembled as a single cane, both the first section and the second section make contact with a surface being traversed by the user of the cane, and wherein both the first section and the second section remain in contact with the surface during the separation of the first section and the second section.

14. The two-in-one cane of claim 1, further comprising a lever disposed to move between a normal position and a fully separated position, wherein said lever allows abutment between the substantially flat region of said first handle and the substantially flat region of said second handle in said normal position with neither said first handle nor said second handle being enclosed by the other, and wherein said lever urges said first section away from said second section in said separated position by initially separating the first handle and second handle while the first tip and second tip remain in contact with one another.

15. The two-in-one cane of claim 1, wherein the first handle and second handle each include a groove formed in a top portion thereof that is configured to receive one or more of a user's fingers to assist in separating the first handle and second handle.

16. The two-in-one cane of claim 1, wherein the first handle and the second handle can be removed from the first elongated component and the second elongated component, respectively, and replaced with at least a third handle and a fourth handle.

17. The two-in-one cane of claim 1, wherein the first tip and the second tip can be removed from the first elongated component and the second elongated component, respectively, and replaced with at least a third tip and a fourth tip.

18. A two-in-one cane comprising:

a) a first section comprising a first elongated component having a length substantially equal to said predetermined length, a first exterior surface, and a first abutment face, wherein one end of the first elongated component is formed as a first handle and an opposite end of the first elongated component is formed as a first tip;

b) a second section comprising a second elongated component having a length substantially equal to said predetermined length, a second exterior surface, and a second abutment face disposed to face said first abutment face of said first section, wherein one end of the second elongated component is formed as a second handle and an opposite end of the second elongated component is formed as a second tip;

c) a plurality of connectors that removably secure said first section to and abreast of said second section in generally parallel relationship to one another and in abutment between said first abutment face and said second abutment face; and d) a lever disposed to move between a normal position and a fully separated position, wherein the plurality of connectors are configured so a user of the cane can separate said first section from said second section by initially separating the first handle and second handle while the first tip and second tip remain in abutment with one another, said lever allows abutment between said first abutment face and said second abutment face in said normal position, said lever urges said first section away from said second section in said separated position by initially separating the first handle and second handle while the first tip and second tip remain in contact with one another, the lever urges the first section away from the second section by rotating a first cam member and a second cam member, and the first cam member has a larger diameter than the second cam member and is disposed closer to the first handle and second handle but further from the first tip and second tip than the second cam member.

19. The two-in-one cane of claim 18, wherein the first cam member and the second cam member are disposed on a first rotatable shaft that rotates along a different axis than the lever.

20. The two-in-one cane of claim 19, wherein the lever is disposed on a second rotatable shaft;

a first gear is disposed on the second rotatable shaft and a second gear is disposed on the first rotatable shaft in rotating engagement with the first gear; and rotating the lever causes the second rotatable shaft to rotate the first gear, which rotates the second gear and the first rotatable shaft, which rotates the first cam member and second cam member.

* * * * *